US005180200A

United States Patent [19]

Georgopoulos et al.

[11] Patent Number: 5,180,200

[45] Date of Patent: Jan. 19, 1993

[54] ROTATABLE SEAL

[75] Inventors: George Georgopoulos, Pine Brook; Richard Gnoinski, North Arlington, both of N.J.

[73] Assignee: E. J. Brooks, Newark, N.J.

[21] Appl. No.: 587,963

[22] Filed: Sep. 25, 1990

[51] Int. Cl.[5] ..... B65D 33/34

[52] U.S. Cl. ..... 292/326; 292/315

[58] Field of Search ..... 292/315, 325, 326, 317

[56] References Cited

U.S. PATENT DOCUMENTS

| | | | |
|---|---|---|---|
| 720,806 | 2/1903 | Hiett | 292/325 X |
| 1,826,033 | 10/1931 | Webster . | |
| 2,003,755 | 6/1935 | Moore | 292/326 X |
| 4,978,026 | 12/1990 | Gnoinski | 292/325 X |

*Primary Examiner*—Richard E. Moore
*Attorney, Agent, or Firm*—John D. Kaufmann

[57] ABSTRACT

An improved security seal includes a plastic housing with a chamber open at one end and a plastic rotor which is insertable in the chamber. The housing wall contains bores aligned across the chamber and two annular grooves adjacent the chamber entrance. Tabs are formed adjacent the chamber entrance. The rotor has a bore and two annular ridges near its top. The ridges are relieved complementarily to the tabs. The rotor may be partially inserted in the housing by snapping the lower ridge into the upper groove and locating the tabs in the relieved areas to align all of the bores so that a seal wire may thereafter be inserted through the seal. The ridge-groove and tab-relief cooperation prevent inadvertent relative rotation of the rotor and housing and full insertion of the rotor. With a seal wire inserted, the rotor and housing are relatively rotated to wrap the wire about the rotor. The rotor is then fully inserted into the housing so each ridge snaps into one groove. This and the engagement of teeth on the bottom of the rotor and the chamber prevent removal of the rotor from the housing, relative rotor-housing rotation, and removal of the wire from the seal. Cowls may surround the housing bores to obviate insertion of an object and levering out of the rotor from the housing.

22 Claims, 5 Drawing Sheets

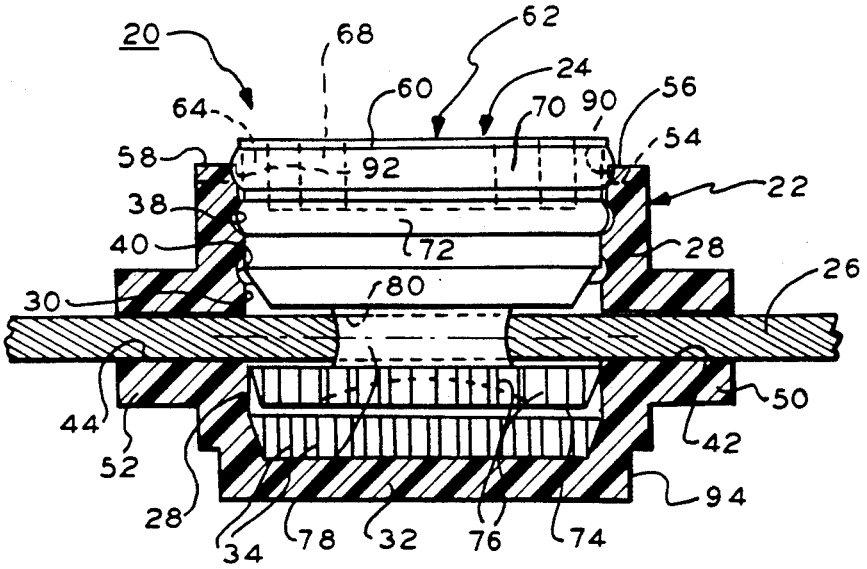
FIG. 6
FIG. 15
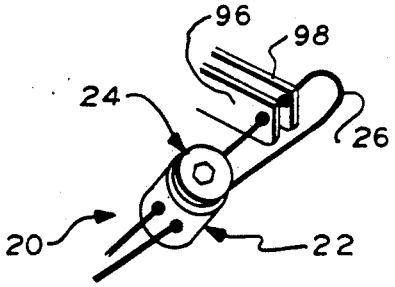
FIG. 13
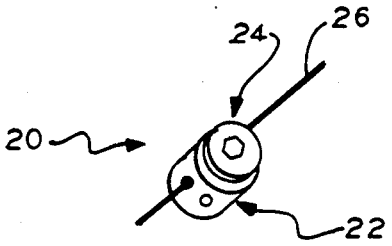
FIG. 14
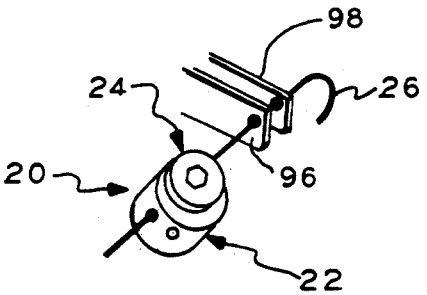
FIG. 16
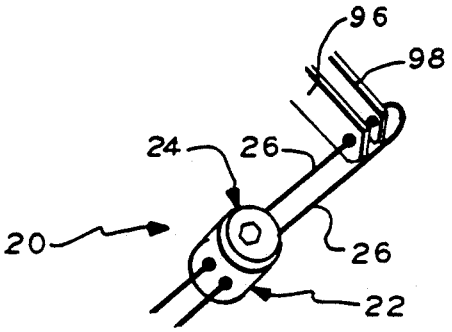

ROTATABLE SEAL

FIELD OF THE INVENTION

This invention relates to an improved seal for securing containers, and, more particularly to an improved rotatable seal for preventing removal of sealing wire from a hasp, staple or similar member of a lock or latch which secures a container. The lock or latch cannot be operated, and the container cannot be opened, without destruction of the seal or breaking the wire. Further, should the wire be pulled from the seal, it cannot be reinserted thereinto.

BACKGROUND OF THE INVENTION

Various devices for sealing the hasps or staples of locks or latches which secure containers such as railroad boxcars, trucks semi-trailers, intermodal containers, barrels, electrical equipment containers and the like, have long been used as a means of assuring the security and integrity of the goods or items contained therein. Typical of such devices is a seal which comprises an elongated, flexible sealing wire and a metal seal. The wire is passed through the hasp or staple and then its ends are retained by the metal seal which is crimped or deformed to prevent removal of the wire ends. Since the presence of the wire prevents operation of the harp or staple, unauthorized entry into the container entails rendering the metal seal or the wire disintegral, thus creating visual evidence of the unauthorized entry.

The invention of commonly assigned application Ser. No. 424,892 filed Oct. 20, 1989 now U.S. Pat. No. 4,978,026 issued Dec. 18, 1990 represents an improvement over the crimped or deformable metal seal. Specifically the '026 invention is a seal which includes a flexible seal wire and two partially interfitted, relatively rotatable members. A flexible seal wire is passed through a hasp, staple or other locking facility and then its ends are inserted through aligned apertures in both of the partially interfitted members. Relative rotation is then imparted between the partially interfitted members to cause the wire to be wrapped around one member and thereby deformed and locked between the members. The members are then completely interfitted to further deform the wire and lock them together.

The improved seal of the '026 patent is less costly than prior art seals because the members may be made of molded plastic by automated equipment. The improved seal also gives a more definite visual indication of unauthorized entry since tampering with the members cracks, chips or crazes them to provide visual evidence of tampering and, if they are rendered disintegral, they are difficult, if not impossible, to put back together.

Examples of other prior art devices predating the '026 patent may be found in U.S. Pat. Nos. 421,951 and 1,911,060.

U.S. Pat. No. 421,951 issued Feb. 25, 1890, discloses a rotatable seal lock wherein a strip seal is inserted within a rotatable member. Thereafter the member is rotated causing a dog to be received within an opening in the strip and pulled within the rotatable member to a retained position. The rotatable member is held against unlocking rotation by the use of a spring-loaded pawl.

U.S. Pat. No. 1,911,060, issued May 23, 1933, discloses a sealing device having a body with apertures through which a flexible sealing means can extend. The center portion of the body is provided with a threaded bore which is intersected by the apertures. Disposed within the threaded bore is a uni-rotational screw which may be tightened down against the flexible securing means to retain it in a sealed position.

While the foregoing seals are beneficial, a need remains for a simple seal capable of securing a container, the seal providing clear evidence of tampering and being economical to manufacture. Further, although the invention of '026 patent represents a major advance over earlier devices, it is desirable to simplify the assembly and use of its seal and to further ensure that such seal cannot be taken apart or rendered disintegral and then later reassembled.

One object of the present invention is to achieve the foregoing desiderata.

It is another object of the present invention to provide a seal that is highly resistant to tampering.

It is a further object of the present invention to provide a seal that provides an indication of any tampering action and which cannot be reassembled after being rendered disintegral.

An additional object of the present invention is to provide a seal which is economical to manufacture and simple to use while at the same time being highly secure.

SUMMARY OF THE DISCLOSURE

These and other objects are achieved by the improved seal of the present invention. The seal is an improvement of the seal in the '026 patent and includes two interfittable members, the first being a male member or rotor and the second being a female member or housing defining a chamber open at one end. The rotor may be partially inserted and held in the chamber and the members may be thereafter relatively rotated. The members each have bores therethrough generally transverse to the axis of relative rotation. The bores are alignable by relative rotation of the interfitted members. The ends of a flexible sealing wire may be passed through the aligned bores, and the members are then relatively rotated to misalign the bore and wrap the wire partially around the rotor which deforms the wire. Following wire deformation, the rotor is fully inserted into the housing member, to further misalign the bores to and lock the members together against disassembly. The deformed wire typically cannot be withdrawn from the members. In the rare instance where the wire is pulled out of the seal without breaking it, the wire cannot be reinserted because of the rotational and insertional misalignment of the bores.

In the '026 patent, partial insertion is achieved by complementary surface features on the members, such as an annular ridge or shoulder on the rotor and an annular groove in the wall of the chamber of the housing. Partial insertion snaps the ridge into the groove which renders the bores in the members coplanar and allows relative rotation of the members to axially align the coplanar bores. Full insertion is achieved by a second lower annular groove in the wall of the chamber. Following deformation of the wire, the rotor is further inserted until its ridge snaps into the lower groove. The members are locked together by the presence of the ridge in the lower groove and by the intermeshing of complementary teeth on the lower end of the rotor and on the lower wall of the chamber in the housing.

In the improved seal, the rotor has two ridges and the chamber has two grooves. Partial insertion of the rotor locates the lower ridge in the upper groove, and wire insertion and deformation proceed as in the '026 patent. Full insertion of the rotor locates each ridge on the rotor in one of the grooves. This increases the difficulty of disassembling the members. The presence of the two ridges permits the lower ridge (and the lower groove) to be smaller diametrically than the upper groove into which it is snapped during partial insertion. This diametric difference permits the members to be easily and freely relatively rotatable when aligning the bores and deforming the wire.

The ridges may be relieved at a selected site. The housing may include a tab which fits into the relief site of each ridge. The tab and relief site are located so that when they interfit, the bores of the members are aligned. Thus, the presence of the lower ridge in the upper groove and the tab/relief site interfitting together permit the members to be easily pre-assembled by the manufacturer with the bores held coplanarly and prealigned and ready for use by end users.

Additionally, the exterior of the housing may include one or more cowls having bores which are extensions of those through the housing. The length of the bores in the cowls prevents insertion of a thin elongated object through the bore of the housing at an angle which could permit levering the members apart.

BRIEF DESCRIPTION OF THE DRAWINGS

A more complete understanding of the improved rotatable seal of the present invention may be had from the following detailed description thereof, particularly when read in the light of the accompanying drawings, wherein:

FIG. 6 is a side, partially sectional view of the members of FIGS. 1-5 partially assembled together with a seal wire;

FIGS. 13-15 are generalized perspective views of the method of assembling the seal of the prevent invention to secure a hasp, staple or the like.

A preferred embodiment of a rotatable seal 20 of the present invention (FIGS. 6-12) is best initially described with reference to FIGS. 1-5. The rotatable seal 20 includes a housing or female member, generally indicated at 22, a rotor or male member, generally indicated at 24, and a flexible seal wire 26 (FIGS. 6-16). The housing and rotor 24 are both preferably molded from plastic.

Figure 1:
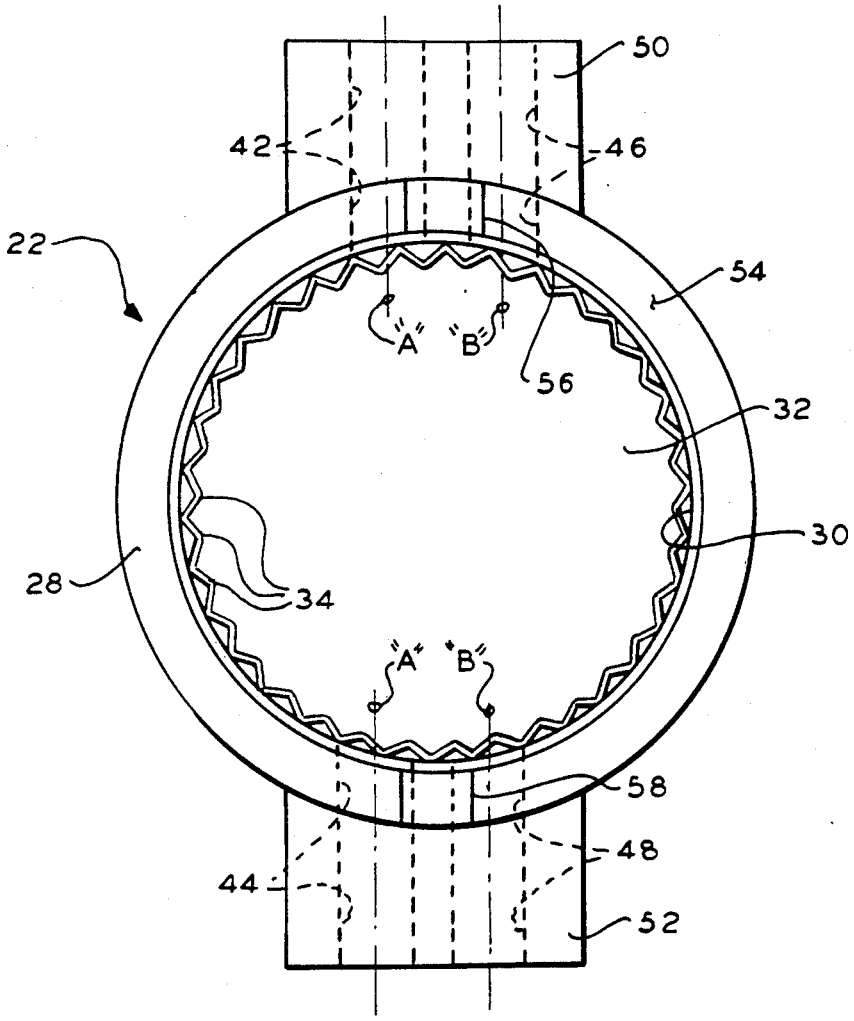
FIG. 1 is a plan view of a female member or housing of the rotatable seal of the present invention.
Figure 2:
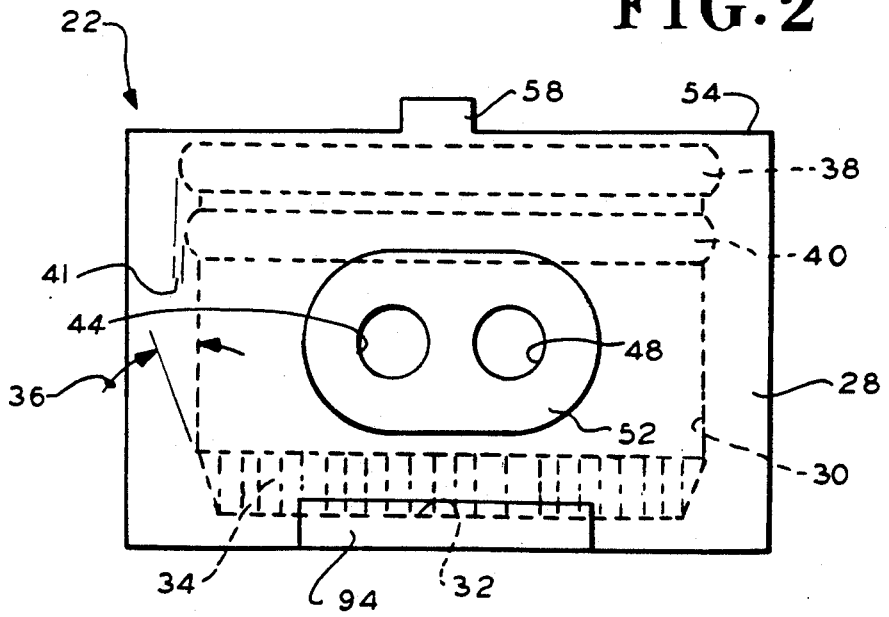
FIG. 2 is a side view of the housing shown in FIG. 1.

Referring first to FIGS. 1 and 2, the housing 22 has a generally cylindrical, vertical wall 28 enclosing a circular cross-section chamber 30 which is closed at one end by a base 32. Formed at the interior juncture of the wall 28 and the base 32 are a plurality of circumferential surface features, such as serrations or teeth 34. The teeth 34 may take any convenient configuration, and in a specific embodiment may be disposed at an acute angle 36 of between 17° and 20° (FIG. 2) with respect to the cylindrical wall 28.

Near the open end of the chamber 30 and formed in the interior of the wall 28 are surface features, such as two generally mutually parallel annular grooves 38 and 40. The diameter of the upper groove 38 is slightly larger than the diameter of the lower groove 40, as shown in FIG. 2 at 41. Formed through the wall 28 below the grooves 38 and 40 and above the teeth 34 are two pairs of bores 42, 44 and 46, 48. The bores 42 and 44 are axially aligned across the chamber 30, as are the bores 46 and 48. Each bore pair 42, 44 and 46, 48 preferably lies on a respective chord "A" or "B" of the cross-section of the chamber 30. Further, the bore pairs 42, 44 and 46, 48 are preferably mutually parallel and parallel to the base 32. Those skilled in the art will appreciate that numerous other arrangements and orientations are possible.

In specific embodiments, the housing 22 includes cowls 50 and 52 integrally formed with the wall 28. The cowls 50 and 52 contain continuations of the bores 42, 46 and 44, 48, respectively, and serve to lengthen these bores 42-48 for a security-related purpose described below.

An upper surface 54 of the wall 28 carries a pair of upstanding tabs 56 and 58, the function of which is explained subsequently. The tabs 56, 58 preferably lie on a diameter of the chamber 30 which is generally parallel to the chords "A" and "B".

Figure 3:
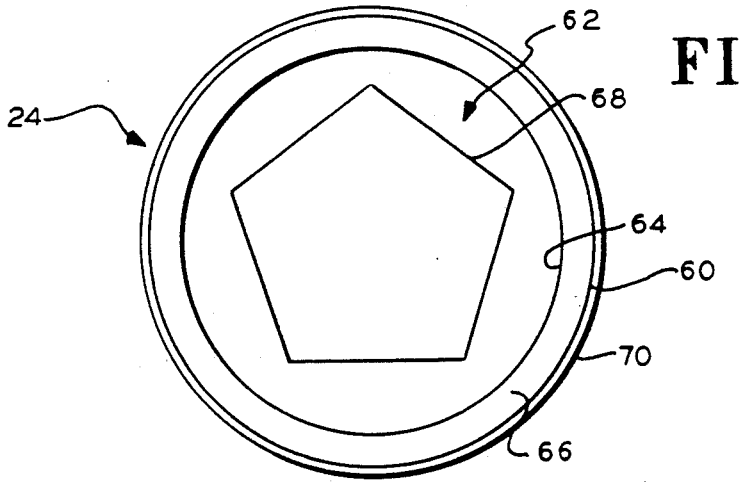
FIG. 3 is a plan view of a male member or rotor of the rotatable seal of the present invention.
Figure 4:
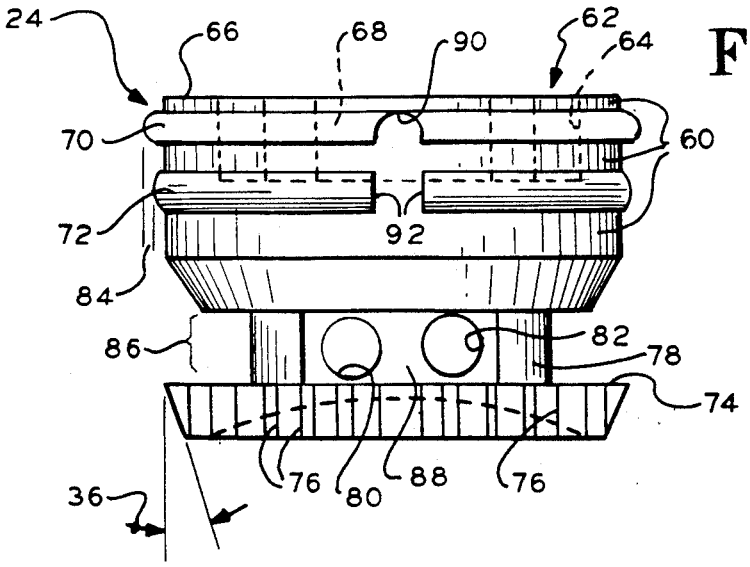
FIG. 4 is a side view of the rotor shown in FIG. 4.
Figure 5:
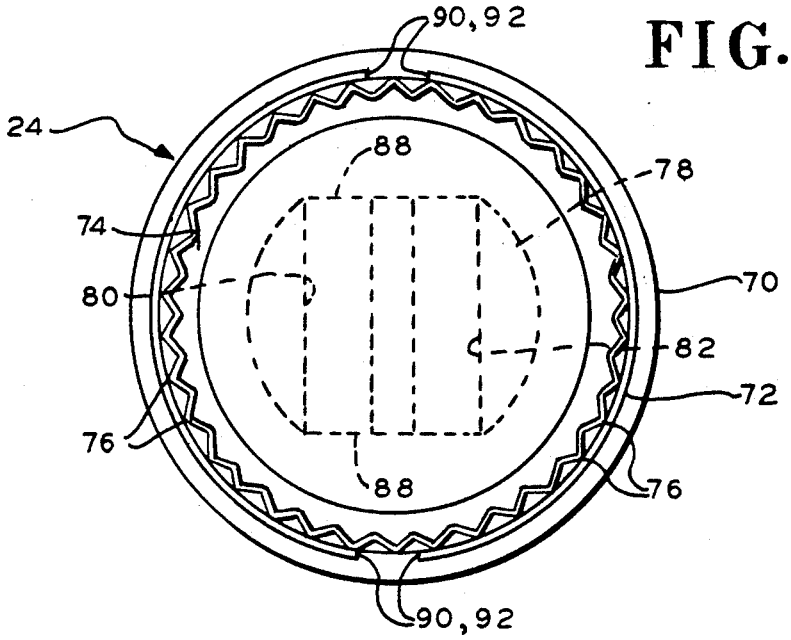
FIG. 5 is a bottom view of the rotor member shown in FIGS. 3 and 4.
Figure 7:
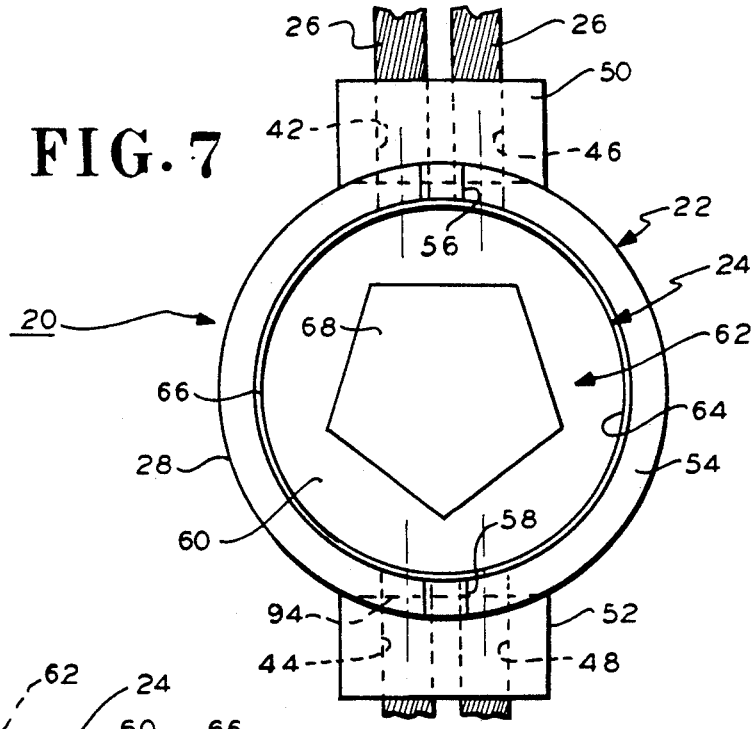
FIG. 7 is a plan view of the members of FIGS. 1-5 assembled together into the rotatable seal of the present invention with a seal wire therethrough.
Figure 8:
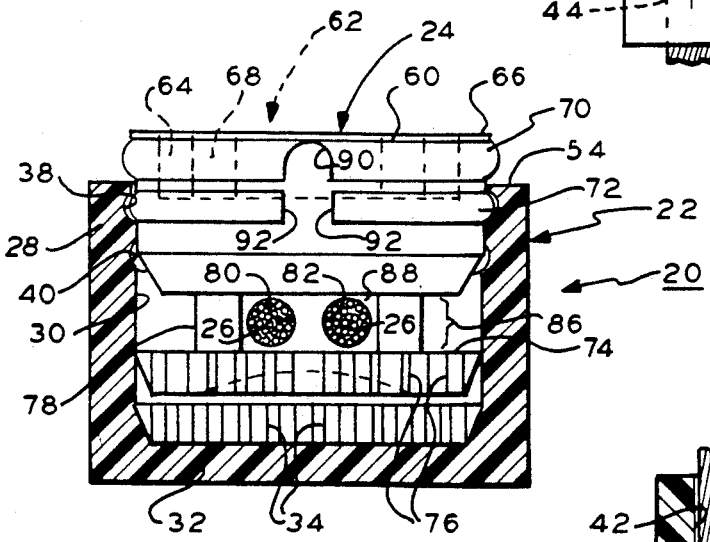
FIG. 8 is a front view, partly in section, of the partially assembled rotatable seal of the present invention.
Figure 9:
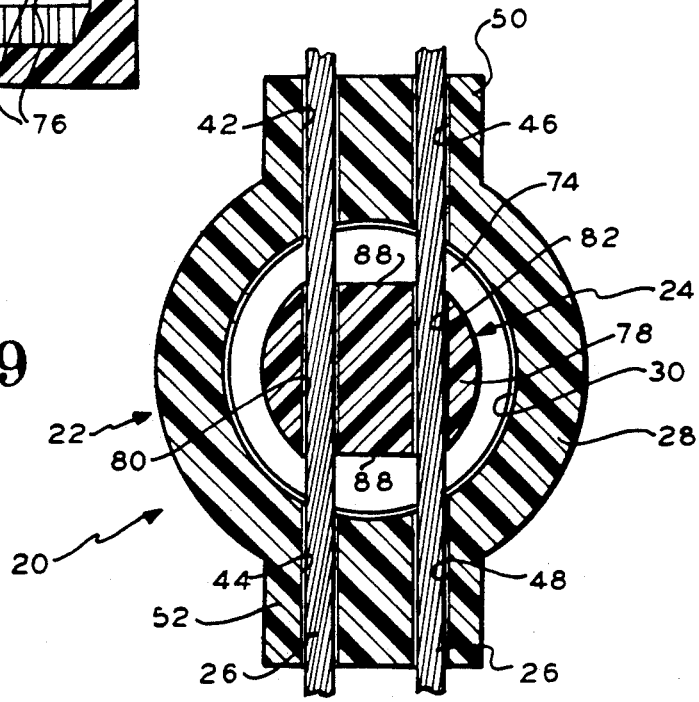
FIG. 9 is a cross-sectional plan view of the rotatable seal of the present invention.

The rotor 24 is shown in detail in FIGS. 3-5. The rotor 24 is generally cylindrical and has various portions of varying diametric dimensions. The rotor 24 includes a circular top or head 60 with a diameter substantially equal to that of the chamber 30. The top 60 contains a tool-engageable portion 62, which in the figures includes a depression 64 defined by a lip 66 with a penta-head member 68 extending up from the depression 64 and spaced inwardly from the ridge 66. The member 68, which may have configuration other than the penta-head, is engageable by a complementary drive socket (not shown) the walls of which fit between the member 68 and the lip 66 for rotation thereof and of the rotor 24, as described below. As will be appreciated, the head 68 may extend above the top 60 although coplanarity between the head 68 and the lip 66 is preferred. The tool-engageable portion 62 may also constitute a shaped female socket (not shown) in the top 60 engageable by a complementary male tool.

Formed integrally on the outside of the top 60 are surface features, such as annular ridges 70 and 72. At the bottom of the rotor 24 is a disk 74 carrying peripheral surface features, such as serrations or teeth 76. Intermediate the top 60 and the disk 74 is a reduced diameter portion 78 having two parallel bores 80 and 87 extending therethrough.

The ridges 70 and 72 are integral with the top 60 and are complementary with the grooves 38 and 40. Of course, the placement of the ridges 70, 72 and grooves 38, 40 can be reversed, with the forms in the chamber 40 and the latter on the rotor 24. Moreover, other complementary surface features may be used.

When the rotor 24 is fully inserted into the chamber 30, the ridge 70 is snapped into the groove 38 simultaneously with the ridge 72 being snapped into the groove 40. The ridge 70 has a larger diameter than the groove 72 as shown at 84. The smaller diameter lower ridge 72 is snapped into the larger diameter upper groove 38 when the rotor 24 is only partially inserted into the chamber 30. The diametric difference between the ridge 72 and the groove 38 permits the rotor 24 to be easily rotated within the chamber 30 relative to the housing 22.

The disk 74 and the teeth 76 thereon are complementary to the teeth 34 in the chamber 30, the teeth being angled from the vertical by the same angle 36 as the teeth 34. When the rotor 24 is fully inserted into the housing 22 and the ridges 70 and 72 are respectively seated in the grooves 38 and 40, the teeth 34 and 76 mesh to prevent relative rotation of the housing 22 and the rotor 24. When the rotor 24 is partially inserted and the ridge 72 is located in the groove 30, the teeth 76 are elevated above and out of engagement with the teeth 34.

The reduced diameter portion 78, the top 60 and the disk 74 define a wire-receiving channel 86 which functions in a manner described below.

Formed integrally on the outside of the top 60 are annular ridges 70 and 72. At the bottom of the rotor 24 is a disk 74 carrying peripheral serrations or teeth 76. Intermediate the top 60 and the disk 74 is a reduced diameter portion 78 having two parallel bores 80 and 87 extending therethrough. The bores 80 and 82 are parallel and are spaced apart by the distance between the bores pairs 42, 44 and 46, 48 in the housing 22. When the lower ridge 72 is retained in the upper groove 38 and the rotor 24 is freely rotatable in the chamber 30 relative to the housing 22, the axes of the bores 80, 82 are coplanar with the axes "A", "B" of the bores 42–48. The rotor 24 may be freely rotated to align the bore 80 with one bore pair 42, 44 (or 46, 48) and to align the bore 82 with the other bore pair 46, 48 (or 42, 44). When the ridges 70 and 72 are retained in their respective grooves 38 and 40 upon full insertion of the rotor 24 into the housing 22, the axes of the bores 80, 82 are below those of the bores 42–48.

The effective size of the channel 86 may be increased by flattening the portion 78 in the areas 88 of both ends of the bores 80 and 82.

The ridges 70 and 72 are relieved, as at areas 90 and 92, respectively. The relieved areas 90, 92 permit conformal receipt therein of the inwardly facing portions of the tabs 56, 58. The tabs 56, 58 may be received in the relieved areas 90, 92 in one of two ways.

First, the rotor 24 may be oriented so that the bottom of the relieved areas 92, overlie the tops of the tabs 56, 58, following which the rotor 24 and the housing 22 are relatively moved axially of the chamber 30 until the bottom of the lower ridge 72 rests on the top surface 54 of the wall 28 with tab 56, 58 residing in the relieved areas 92. Subsequent partial insertion of the rotor 24 into the chamber 30 causes the tabs 56, 58 to first move through the relieved areas 92 and into the relieved areas 90, with the tabs 56, 58 now residing in both relieved areas 90, 92. As the tops of the tabs 56, 58 move into the relieved areas 90, the lower ridge 72 enters the upper groove 38 as described above.

Second, the flexibility of the plastic rotor 24 and housing 22 permits the lower ridge 72 to be snapped to the upper groove 38 with the tabs 56, 58 and the relieved areas 90, 92 misaligned. Following this partial insertion of the rotor 24 into the chamber 30, the rotor 24 and the housing 22 may be relatively rotated until the tabs 56, 58 snap into their respective relieved areas 90, 92.

With the tabs 56, 58 residing in the relieved areas 90, 92 and the lower ridge 72 in the upper groove 38—however this condition is achieved—inadvertant relative rotation of the housing and rotor 22 and 24 is prevented, as are inadvertant disassociation or full insertion of the partially inserted rotor 24 from or into the housing 22. The relieved areas 90, 92, the tabs 56, 58 and the bores 42–48 and 80, 82 are angularly and positionally located so that each bore 80 and 82 is aligned with one bore pair 42, 44 or 46, 48 when the foregoing condition is achieved.

FIGS. 6–9 show the rotatable seal 20 of the present invention in an opened or unsealed condition, i.e., with the rotor 24 partially inserted into the housing 22 and the seal wire 26 extending therethrough. In the opened or unsealed condition of the rotatable seal 20, the lower annular ridge 72 of the rotor 24 resides in the upper annular groove 38 of the housing 22. In this condition, as explained above, the bores 42–48 of the housing 22 are held in alignment with rotor bores 80, 82 by the tabs 56, 58 and the relieved areas 90, 92. There are thus formed two parallel passageways 42-80-44 and 46-82-48 through the rotatable seal 20 for the seal wire 26.

Figure 10:
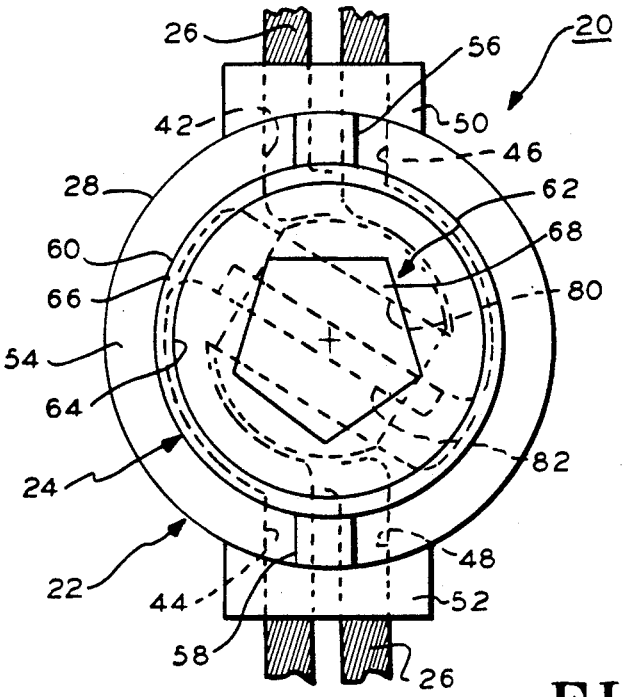
FIG. 10 is a plan view of the rotatable seal of the present invention similar to FIG. 7 but showing the deformed seal wire therein.
Figure 11:
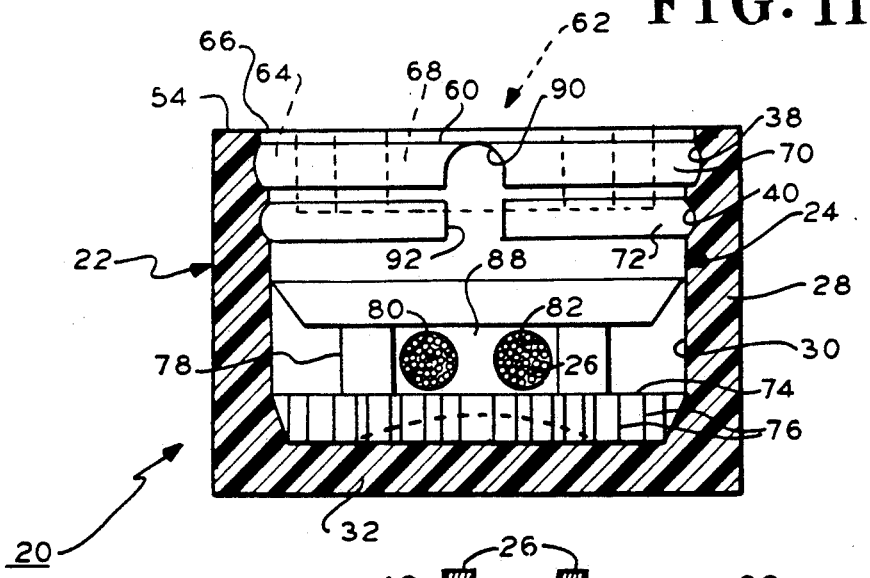
FIG. 11 is a front view, partly in section, of the fully assembled rotatable seal of the present invention.
Figure 12:
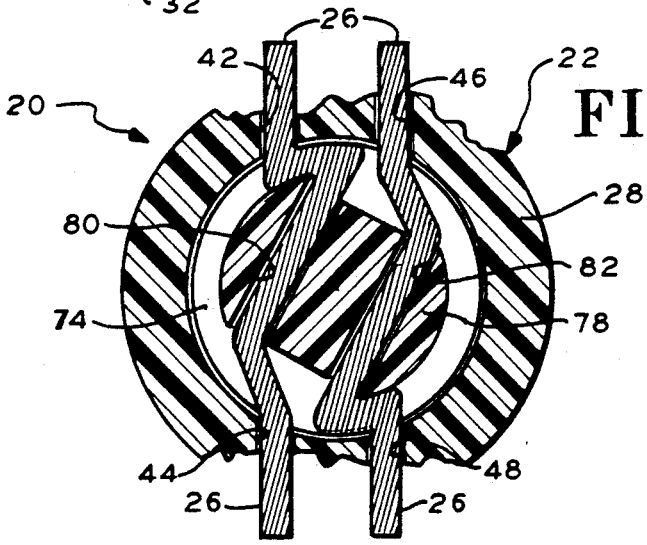
FIG. 12 is a cross-sectional plan view of the rotatable seal of the present invention at the beginning of initiation of deformation of the seal wire.

FIGS. 10 and 11 show rotor 24 fully inserted into the housing 22 and with the rotatable seal 20 of the present invention in a closed or sealed condition. As best may be seen by viewing, in order, FIGS. 9, 12, 10 and 11, the seal wire 26 is first passed through the passageways 42-80-44 and 46-82-48 (FIG. 9), following which the seal wire 26 is deformed by rotating the rotor 20 relative to the housing 22 (FIG. 12). This relative rotation causes the bores 80 and 82 to be rotated out of alignment with the bore pairs 42, 44 and 46, 48 of the housing 22. The rotor 24 is rotated by the engagement and rotation of the head 68 by a tool (not shown) in the area 62. The bottom of the housing 22 may contain indentations 94 to assist in holding the housing 22 against rotation if deformation of the wire 26 requires high torque. At the same time or immediately after the time that the rotor 24 is rotated within the housing 22, the rotor 24 is also fully inserted and moved inwardly into the housing 22 (FIGS. 10 and 11) by the same or a different tool so that the annular ridges 70 and 72 are moved into mating engagement with their respective annular grooves 38 and 40. At the same time, the teeth 76 of the rotor 24 are moved into locking engagement with the teeth 34 of the housing 22 (FIG. 11).

It can be seen when the rotatable seal 20 is in the closed or sealed condition as shown in FIGS. 10 and 11, the seal wire 26 is firmly locked within the rotatable seal 20. The locking is accomplished by the rotational and insertional deformation of the seal wire 26 together with the concurrent locking engagement of the teeth 34 and 76 and the frictional engagement of the ridges 70 and 72 with grooves 38 and 40. When the seal wire 26 has been deformed there is a high resistance to any further relative rotation of the housing 22 and the rotor 24 or to reopening of the rotatable seal 20. The engagement of the teeth 34 and 76 also prevents relative rotation of the members 22 and 24.

As seen in FIGS. 10 and 12, deformation of the seal wire 26 includes the wire 26 first being wrapped around the portion 78 of the rotor 24, with the wrapped wire 26 occupying and filling the channel 86 with the chamber 30. The flattened areas 88 on the portion 78 create additional volume for the wire 26 to prevent jamming as the members 22 and 24 are relatively rotated. After a selected amount of rotation of the rotor 24 (that shown in FIG. 10 being typical but not mandatory) with the rotor 24 partially inserted (the ridge 72 is in the groove 38), the rotor 24 is then fully inserted (the ridge 72 is in the groove 40, the ridge 70 is in the groove 38). Full insertion of the rotor 24 further deforms the wire 26 in a direction parallel to the axis of rotation of the rotor 24. Both types of deformation of the wire 26—wrapping and axial—prevent removal of the wire 26 from the seal 20 and opening of the seal 20. When the seal 20 is closed, the head 60 of the rotor 24 is preferably coplanar and forms a smooth surface with the upper surface 54 of the wall 28 of the housing 22. Such smooth surface makes it difficult for any tampering action to separate the rotor 24 from the housing 22 after closing of the rotatable seal 20 has been achieved accomplished.

Other features of the seal 20 also contribute to obviating disassembly of the seal 20. First, as noted, the two modes of deforming the wire tend to resist removal of the rotor 24 from the housing 22. Second, the presence of two interfitted ridge-groove pairs 38–70 and 40–72 requires an increased force to open the seal 20. Third, the teeth 34, 76 also help to defeat opening of the seal 20. Fourth, the cowls 50 and 52, if present, obviate the insertion of a slender elongated object into one of the bores 42–48 and the levering of the rotor 24 by an engaging end of the object out of the chamber 30. The effective lengthening of the bores 42–48 by the cowls 50 and 52 prevents the object from being able to engage the rotor 24 in a position where levering forces can be applied.

If the rotor 24 and housing 22 are, as preferred, molded from plastic, attempts to tamper with the seal 20 will be evident by the chipping, cracking or crazing thereof following the application of tampering forces.

FIGS. 13–16 diagrammatically show the operation of the rotatable seal 20 of the present invention. FIG. 13 shows one end of the flexible seal wire 26 through the rotatable seal 20 with the rotor 24 partially inserted. FIG. 14 shows the other end of the wire 26 inserted through openings in relatively movable members 96 and 98 (hasps, staples, latches, etc.) of a latch, lock or the like. FIG. 15 shows the other end of the wire 26 passing back through the still opened rotatable seal 20. FIG. 16 shows the rotatable seal 20 after it has been closed and locked in the sealing position by fully inserting the rotor 24 into the housing 22.

The housing 22 and rotor 24 of the rotatable seal 20 may be made from strong and essentially semi-rigid materials such as metal, rubber, plastics, etc. A preferred material is acrylic plastic. The housing 22 and rotor 24 of the rotatable seal 20 may also be made from clear materials so that the positive locking of the seal wire 26 can be inspected and can also provide a visual indication of tampering.

The flexible seal wire 26 used with the rotatable seal 20 of the present invention may be in the form of wire, or rope, or cable, and may be made of metal or plastic or other suitable materials.

When the seal 20 is in the closed condition, the interfitting members 22 and 24 must be destroyed, or the sealing wire must be cut, in order to remove the seal 20 from the members 96 and 98 so that these members can be moved or operated. Due to the strong materials of construction, substantial effort is required either to destroy the members 22 or 24 or to cut the wire 26. However, if such destruction or cutting is effected, there is provided an easily detectable indication of tampering.

The conjoint action of the tabs 56, 58 and the relieved areas 90, 92 and of the lower ridge 72 and the upper groove 38, permits the manufacturer of housings 22 and rotors 24 to easily preassemble them with the rotor 24 partially inserted and with the passageways 42-80-44 and 46-82-48 ready to receive the ends of the wire 26. Since this partial insertion requires low force—the lower ridge 72 has a smaller diameter than the upper groove 38—and since bore alignment is automatically achievable by the action of the tabs 56, 58 and the relieved areas 90, 92 via relative rotor-housing 24-22 rotation—either before or after ridge-groove 72-38 engagement—an unskilled, low cost labor force can readily and quickly preassemble the seal 20 into a ready-to-use open condition.

While the present invention has been described with regard to certain embodiments, it should be understood that variations and modifications will be obvious to those skilled in the art without departing from the scope of the present invention as defined in the appended claims.

What is claimed is:

1. An improved seal of the type which includes a flexible wire insertable through an item to be secured, the seal being non-removably affixable to the wire to prevent opening operation of the item absent rendering the wire or the seal disintegral, such disintegrity providing a visual indication that such operation has been attempted or has occurred; wherein the improvement comprises:

a walled housing defining a chamber and having first and second aligned bores formed therethrough on opposite sides of the chamber;

a rotor conformally receivable in the chamber and having a third bore therethrough;

first means (a) for holding the rotor partially inserted in the chamber with the third bore coplanar with the first and second bores, (b) for permitting the partially inserted held rotor and the housing to be easily relatively rotated about an axis generally transverse to the axis of the bores to align the coplanar bores for receipt of the wire through all thereof, and (c) for permitting the partially inserted and held rotor and the housing to be relatively rotated after insertion of the wire through the bores so as to partially wrap and deform the received wire about the rotor;

second means for preventing inadvertant non-alignment of the bores prior to receipt of the wire in the bores and following alignment-effecting relative rotation of the partially inserted rotor and the housing until the rotor and the housing are relatively rotated to wrap and deform the wire; and third means for holding the rotor fully inserted in the chamber following wrapping and deformation of the wire and for preventing relative rotation of the fully inserted rotor and the housing.

2. An improved seal in claim 1, wherein:

the first means comprises complementary surface features on the rotor and the chamber wall.

3. An improved seal as in claim 1, which further comprises:

fourth means for preventing the removal of the fully inserted rotor from the chamber by an object inserted into the first or second bore.

4. An improved seal as in claim 1, wherein:

the first means comprises a first annular ridge on the rotor, and a first annular groove complementary with the ridge and formed in the housing wall within the chamber.

5. An improved seal as in claim 4, wherein:

the second means comprises a tab formed on the housing wall at the point of insertion of the rotor into the chamber, and a relieved area complementary with the tab and formed in the annular ridge.

6. An improved seal as in claim 5, wherein:

partial insertion of the rotor into the chamber is accompanied by the ridge snapping into the groove, following which relative rotation of the rotor and the housing causes the tab to snap into the relieved area as the bores become aligned, the receipt of the ridge in the groove being capable of preventing inadvertent further insertion or the removal of the rotor from the housing, the receipt of the tab in the relieved area being capable of preventing inadvertent relative rotation of the rotor and the housing, the ridge-groove cooperation and the tab-relief cooperation being capable of being overcome by intentionally applied forces respectively incident to relative rotor-housing rotation to wind the wire and full insertion of the rotor.

7. An improved seal as in claim 4, wherein:

the third means comprises a second annular ridge formed on the rotor above, and having a larger diameter than, the first ridge, and a second annular groove complementary with the second ridge and formed in the housing wall within the chamber below, and having a smaller diameter than, the first groove, the second ridge being conformally receivable in the first groove and the first ridge being conformally receivable in a second groove when the rotor is fully inserted into the housing, the first ridge being loosely receivable in the first groove when the rotor is partially inserted into the housing.

8. An improved seal as in claim 7, wherein:

the second means comprises a tab formed on the housing wall at the point of insertion of the rotor, and aligned relieved areas complementary with the tab and formed in the first and second annular ridges.

9. An improved seal as in claim 8, wherein:

the third means comprises the first ridge and groove, and partial insertion of the rotor into the chamber is accompanied by the first ridge snapping into the first groove, following which relative rotation of the rotor and the housing causes the tab to snap into the relieved areas as the bores become aligned, the receipt of the first ridge in the first groove being capable of preventing inadvertent further insertion or removal of the rotor from the housing, the receipt of the tab in the relieved areas being capable of preventing inadvertent relative rotation of the rotor and the housing, the ridges-grooves cooperation and the tab-relief cooperation being capable of being overcome by intentionally applied forces respectively incident to full insertion of the rotor and relative rotor-housing rotation to wind the wire, full insertion of the rotor conformally locating the first ridge in the second groove and conformally locating the second ridge in the first groove.

10. An improved seal as in claim 9, wherein:

the third means further comprises a plurality of teeth formed on the rotor, and a plurality of teeth formed on the housing within the chamber, the teeth on the rotor engaging the teeth in the chamber to prevent relative rotation of the rotor and the housing when the rotor is fully inserted, the teeth being out of engagement when the rotor is partially inserted into the chamber.

11. An improved seal as in claim 3, wherein:

the fourth means comprises first and second cowls integral with the exterior of the housing, the cowls surrounding and providing their external extensions of the first and second bores, the extensions of the bores preventing the inserted object from being used as a lever against the rotor to remove the fully inserted rotor from the chamber.

12. An improved seal as in claim 1, wherein:

with the rotor fully inserted following relative rotation of the rotor and the housing, the bores are rotationally misaligned and misaligned via non-coplanarity to prevent insertion of an item through the bores.

13. An improved seal of the type which includes a flexible wire insertable through an item to be secured, the seal being non-removably affixable to the wire to prevent opening operation of the item absent rendering the wire or the seal disintegral, such disintegrity providing a visual indication that such operation has been attempted or has occurred; wherein the improvement comprises:

a walled housing defining a chamber and having first and second aligned bores formed therethrough on opposite sides of the chamber;

a rotor conformally receivable in the chamber and having a third bore therethrough;

first means (a) for simultaneously (i) holding the rotor partially inserted in the chamber with the third bore coplanar and aligned with the first and second bores for receipt of the wire through all thereof, and (ii) preventing inadvertant non-alignment of the third bore relative to the first and second bores, and (b) for permitting the partially inserted and held rotor and the housing to be intentionally relatively rotated after insertion of the wire through the bores so as to partially wrap and deform the received wire about the rotor; and second means for holding the rotor fully inserted in the chamber following wrapping and deformation of the wire and for preventing relative rotation of the fully inserted rotor and the housing.

14. An improved seal as in claim 13, wherein:

the first means comprises complementary surface features on the rotor and the chamber wall.

15. An improved seal as in claim 13, which further comprises:

third means for preventing the removal of the fully inserted rotor from the chamber by an object inserted into the first or second bore.

16. An improved seal as in claim 13, wherein:

the first means comprises a first annular ridge on the rotor;

a first annular groove complementary with the ridge and formed in the housing wall within the chamber;

a tab formed on the housing wall at the point of insertion of the rotor into the chamber; and a relieved area complementary with the tab and formed in the annular first ridge.

17. An improved seal as in claim 16, wherein:

partial insertion of the rotor into the chamber is accompanied by, first, alignment of the tab with the relieved area and then snapping the first ridge into the first groove to align the bores, the receipt of the first ridge in the first groove being capable of preventing inadvertent further insertion or removal of the rotor from the housing, the receipt of the tab in the relieved area being capable of preventing inadvertent relative rotation of the rotor and the housing, the first ridge-groove cooperation and the tab-relief cooperation being capable of being overcome by intentionally applied forces respectively incident to relative rotor-housing rotation to wind the wire and full insertion of the rotor.

18. An improved seal as in claim 16, wherein:

the second means comprises a second annular ridge formed on the rotor above, and having a larger diameter than, the first ridge, the second ridge having a relieved area aligned with that in the first ridge and being complementary with the tab; and a second annular groove complementary with the second ridge and formed in the housing wall within the chamber below, and having a smaller diameter than, the first groove, the second ridge being conformally receivable in the first groove and the first ridge being conformally receivable in the second groove when the rotor is fully inserted into the housing, the first ridge being loosely receivable in the first groove when the rotor is partially inserted into the housing.

19. An improved seal as in claim 18, wherein:

the second means further comprises the first ridge and groove, and partial insertion of the rotor into the chamber is accompanied by alignment of the tab with the relieved areas prior to the first ridge snapping into the first groove, following which the bores are aligned, the receipt of the first ridge in the first groove being capable of preventing inadvertent further insertion or removal of the rotor from the housing, the receipt of the tab in the relieved areas being capable of preventing inadvertent relative rotation of the rotor and the housing, the first ridge-groove cooperation and the tab-relieved areas cooperation being capable of being overcome by intentionally applied forces respectively incident to full insertion of the rotor and relative rotor-housing rotation to wind the wire, full insertion of the rotor conformally locating the first ridge in the second groove and conformally locating the second ridge in the first groove.

20. An improved seal as in claim 19, wherein:

the third means further comprises a plurality of teeth formed on the rotor, and a plurality of teeth formed on the housing within the chamber, the teeth on the rotor engaging the teeth in the chamber to prevent relative rotation of the rotor and the housing when the rotor is fully inserted, the teeth being out of engagement when the rotor is partially inserted into the chamber.

21. An improved seal as in claim 13, wherein:

the third means comprises first and second cowls integral with the exterior of the housing, the cowls surrounding and providing external extensions of the first and second bores, the extensions of the bores preventing the inserted object from being used as a lever against the rotor to remove the fully inserted rotor from the chamber.

22. An improved seal as in claim 13, wherein:

with the rotor fully inserted following relative rotation of the rotor and the housing, the bores are rotationally misaligned and misaligned via noncoplanarity to prevent insertion of an item through the bores.

* * * * *